US007731055B2

(12) United States Patent
Arnoldo et al.

(10) Patent No.: US 7,731,055 B2
(45) Date of Patent: Jun. 8, 2010

(54) LID OPENING MECHANISM

(75) Inventors: Sven Arnoldo, Malsch (DE); Burkhard Jägersküpper, Karlsruhe (DE); Nelly Cësar, Karlsruhe (DE)

(73) Assignee: Faurecia Innenraum Systeme GmbH, Hagenbach (DE)

( * ) Notice: Subject to any disclaimer, the term of this patent is extended or adjusted under 35 U.S.C. 154(b) by 109 days.

(21) Appl. No.: 11/664,588

(22) PCT Filed: Oct. 2, 2005

(86) PCT No.: PCT/DE2005/001768

§ 371 (c)(1),
(2), (4) Date: Sep. 19, 2007

(87) PCT Pub. No.: WO2006/037307

PCT Pub. Date: Apr. 13, 2006

(65) Prior Publication Data

US 2008/0016776 A1 Jan. 24, 2008

(30) Foreign Application Priority Data

Oct. 5, 2004 (DE) ..... 10 2004 048 457
Oct. 5, 2004 (DE) ..... 10 2004 048 470

(51) Int. Cl.
*B65D 43/16* (2006.01)
*B65D 43/22* (2006.01)

(52) U.S. Cl. ..... 220/817; 220/827; 220/835

(58) Field of Classification Search ..... 220/817, 220/827, 835, 244
See application file for complete search history.

(56) References Cited

U.S. PATENT DOCUMENTS 1,774,199 A * 8/1930 Good ..... 296/76
2,736,455 A * 2/1956 Rosen ..... 220/521
3,048,899 A * 8/1962 Vincent et al. ..... 49/152
3,403,473 A 10/1968 Navarro
4,811,518 A * 3/1989 Ladisa ..... 49/193
5,067,625 A * 11/1991 Numata ..... 220/827
5,195,272 A * 3/1993 Yamada ..... 49/193
5,357,652 A * 10/1994 Yamada ..... 16/232
5,367,828 A * 11/1994 Hashemnia ..... 49/382
5,647,652 A * 7/1997 Zalewski et al. ..... 312/324

(Continued)

FOREIGN PATENT DOCUMENTS

DE 101 51 704 A1 5/2003

(Continued)

*Primary Examiner*—Anthony Stashick
*Assistant Examiner*—Niki M Eloshway
(74) *Attorney, Agent, or Firm*—Arent Fox LLP

(57) ABSTRACT

A lid opening mechanism (A) for opening a lid element (1) on a first side (Y1) around the first axis of rotation (21) of the lid or selectively on the other side (Y1) around of the second axis or rotation (22), wherein each first (21) and second (22) axes of rotation are formed by the front (21*a* or 21*b*) or rear (22*a* or 22*b*) element of the axis of rotation and a lid actuating device (B) comprises hinge strips (30*a*, 30*b*) each of which is rotating mounted in the area or the first lid-opening side (11) on the thrust sides (6*a*, 6*b*) of the lid element (D) transversally with respect to the longitudinal sides (11, 12) and bearing devices (63*a*, 63*b*; 62*a*, 62*b*) for receiving the elements (21*a*, 21 or 22*a*, 22*b*) of the axes of rotation.

3 Claims, 8 Drawing Sheets

U.S. PATENT DOCUMENTS

| | | | | |
|---|---|---|---|---|
| 5,931,336 | A | 8/1999 | Takeuchi | |
| 5,983,453 | A * | 11/1999 | Miwa | 16/231 |
| 6,142,333 | A * | 11/2000 | Sasamoto et al. | 220/264 |
| 6,688,657 | B2 * | 2/2004 | Peacock et al. | 292/35 |

FOREIGN PATENT DOCUMENTS

| | | | |
|---|---|---|---|
| DE | 101 64 340 | C1 | 10/2003 |
| DE | 102 47 453 | A1 | 4/2004 |
| EP | 0 494 496 | B1 | 7/1992 |
| EP | 0 562 244 | B1 | 9/1993 |
| JP | 03-189249 | A | 1/1993 |

* cited by examiner

LID OPENING MECHANISM

CROSS-REFERENCE TO RELATED APPLICATION

This application is a National Stage entry of International Application No. PCT/DE2005/001768, filed Oct. 2, 2005, the entire specification claims and drawings of which are incorporated herewith by reference.

The invention relates to a lid opening mechanism, in particular for use for a central console of a motor vehicle.

EP 0 494 496 B1 discloses a releasable double hinge device for a console box.

EP 0 562 244 B1 discloses a lid opening and closing device which is designed in such a manner that a lid body of a crate body can be opened and closed from either the right or the left side.

JP 031327826 discloses an opening mechanism with which a lid can be opened on two sides. In this case, the pivot spindles are each divided into two. In order to open the lid on one side, the pivot-spindle parts of the respective other side are pressed apart in a wedge-shaped manner in order to retract the ends of the pivot-spindle parts into corresponding receptacles of the container and to form an effective pivot spindle.

DE 101 51 704 C2 also discloses an opening mechanism for opening a lid on both sides, in which the pivot spindles are each divided into two. The pivot spindles are moved apart or brought together by a likewise two-part actuating element, which runs transversely to them, at its ends having guide tracks in which projections of respective, mutually facing ends of the pivot-spindle parts are guided in such a manner that the pivot-spindle parts of the one side are moved apart when the pivot-spindle parts of the other side are brought together. The two parts of the actuating element are prestressed into a moved-apart position by means of a spring.

A mechanism acting in a similar manner is disclosed in U.S. Pat. No. 5,931,336.

It is the object of the invention to provide a lid opening mechanism which is constructed in a simple manner and ensures reliable operation.

This object is achieved by the features of the independent patent claims. Further embodiments are specified in the subclaims which are each referred back thereto.

According to the invention, a lid opening mechanism is provided for opening a lid element on a first side about a first lid pivot spindle or optionally on a second side about a second lid pivot spindle, wherein the first pivot spindle and the second pivot spindle are each formed from a front pivot-spindle element and a rear pivot-spindle element, which are each movable between a retracted position and an extended position, with a first actuating device having a first actuating element and a second actuating device having a second actuating element, which are respectively mechanically coupled to the front pivot-spindle element and the rear pivot-spindle element of the first pivot spindle and of the second pivot spindle in such a manner that, by actuation of one of the actuating elements, the front pivot-spindle element and the rear pivot-spindle element of the associated pivot spindle are moved into corresponding guide devices connected to the console, and therefore the first pivot spindle or the second pivot spindle connect as the pivot spindle for opening the lid on the opposite side in each case, wherein the lid actuating device comprises:

hinge strips, each of which is mounted rotatably in the region of a first lid opening side by means of hinge-strip spindles at those ends of the hinge strips which, in the region of the first longitudinal side, are arranged on impact sides of the lid element, which sides run transversely with respect to the longitudinal sides, and which hinge strips have mounting devices for receiving the pivot-spindle elements, in order to be able to pivot up the lid element on the second longitudinal side when the first pivot-spindle elements are retracted into the mounting devices of the hinge strips and the second pivot-spindle elements, in a retracted position, are moved back out of the mounting devices and partially reach into mounting devices of the hinge strips, with the pivot-spindle elements on the second longitudinal side, in an extended position, reaching through the mounting devices of the hinge strips and reaching into mounting devices in the console in order to form a swivel joint between the lid element and the hinge strips in the region of the second longitudinal side if, at the same time, the pivot-spindle elements of the first pivot spindle are moved out of the mounting devices of the hinge strips, and therefore the lid element can be pivoted up on the first longitudinal side.

The hinge strips can be respectively mounted on the front part and on the rear part of the console counter to a spring prestress.

Each actuating device of the lid opening mechanism can also have an actuating rod by means of which each actuating element is coupled to the control element, with the control element being arranged between the actuating rods and having control surfaces facing the latter, in which actuating device, upon a movement by an actuating rod, the control element is pushed relative to the other actuating rod into a position in which this other actuating rod cannot move the control element.

The invention is described below with reference to the attached drawings, in which.

Figure 9:
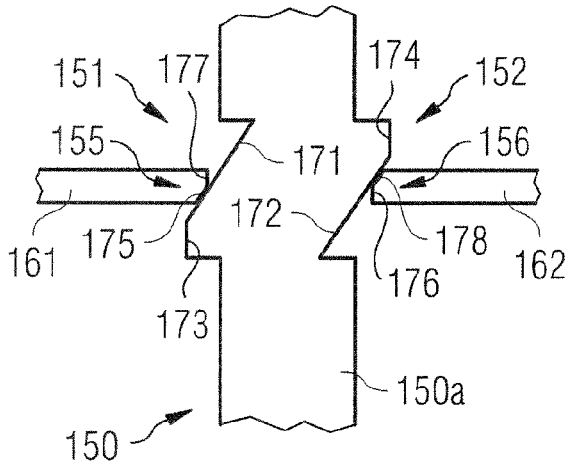
Figure 10:
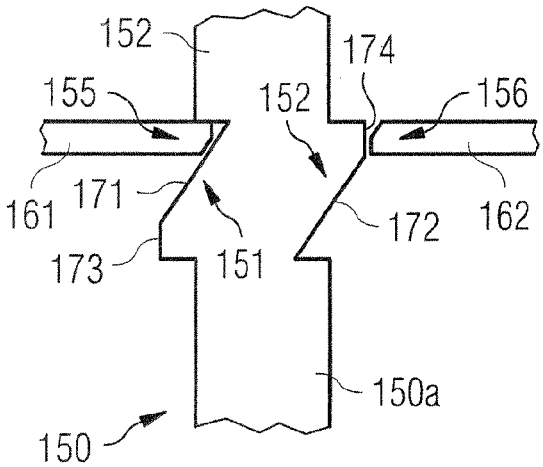
Figure 11:
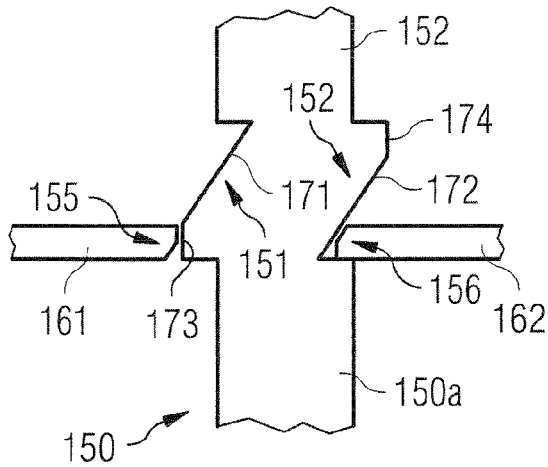
Figure 12:
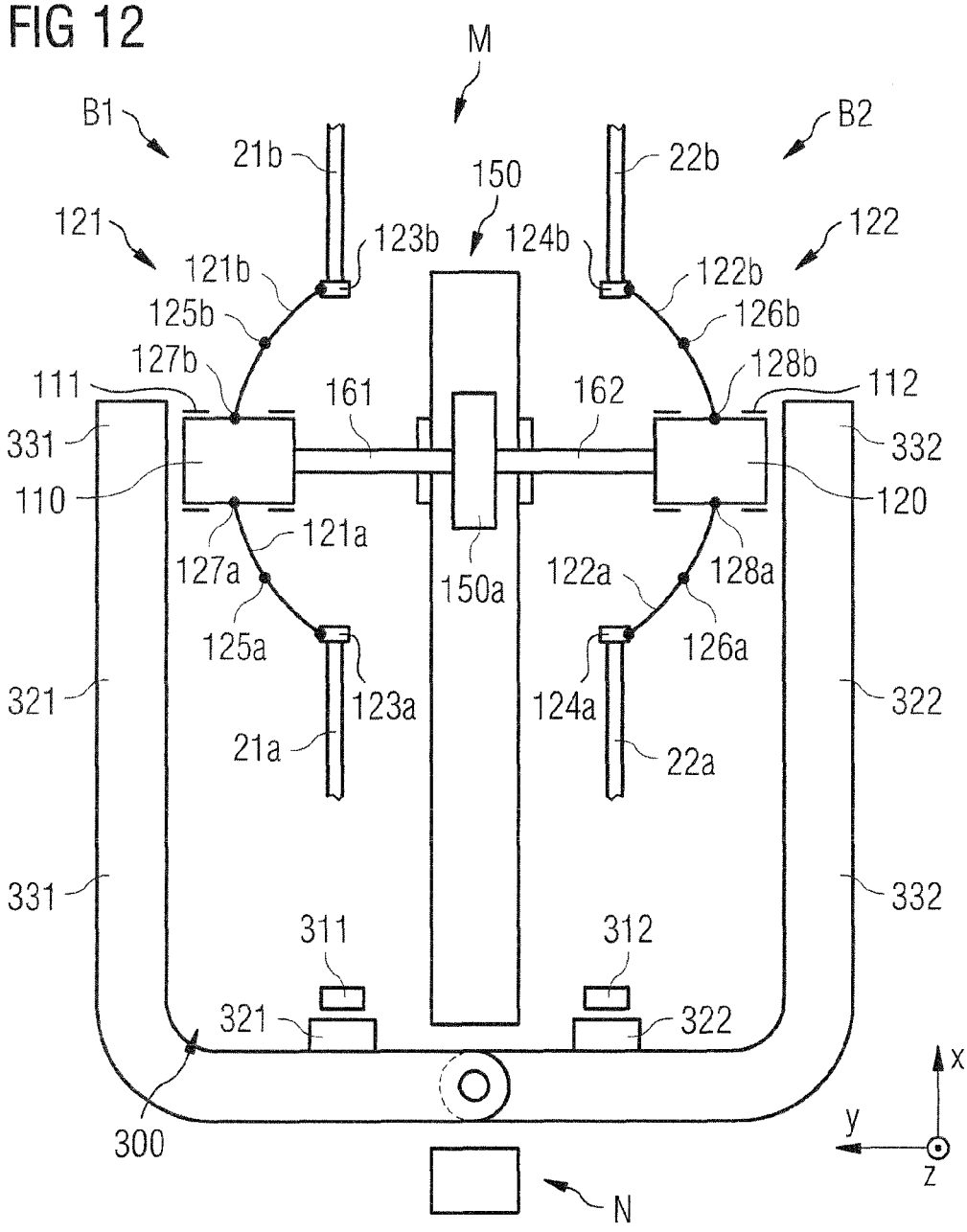
Figure 13:
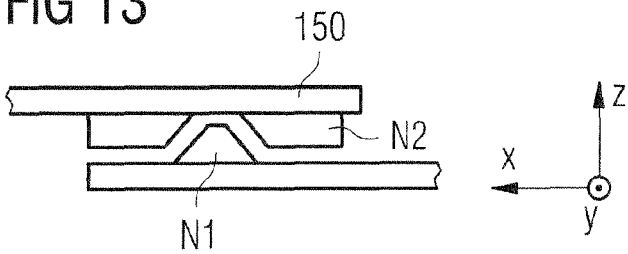

FIG. 9 shows a partial illustration of the pivot-spindle control device with a control slide and parts of the actuating rods each in a neutral position, FIG. 10 shows the illustration of the pivot-spindle control device according to FIG. 9, in which a first actuating rod is in a release position and the second actuating rod is in a locked position, FIG. 11 shows the illustration of the pivot-spindle control device according to FIG. 9, in which the second actuating rod is in a release position and the first actuating rod is in a locked position, FIG. 12 shows a development of the invention, in which the pivot-spindle control device and a blocking device are shown, FIG. 13 shows a cutout of a cross section in the XZ plane of elements, illustrated in FIG. 12, of the blocking device.

In order to describe the invention, reference is made to a reference coordinate system with an X, a Y and a Z axis. With the lid opening mechanism according to the invention, a lid element or lid D, which is arranged on a console K, can be opened from a first side Y1 and a second side Y2, such that the lid D can then be pivoted up to the particular side. The X axis runs transversely with respect to these sides. In the case of the arrangement of the lid opening mechanism A according to the invention on a storage compartment of a central console in a motor vehicle, the X axis preferably runs in the assumed direction of travel of the vehicle. For this situation, for example, Y1 can denote the driver's side and Y2 the passenger's side.

The console K preferably has a storage compartment which the lid D entirely or partially covers in its closed position. The further description is based on a front part 1*a*, seen in the X direction, and a rear part 1*b* of the console K, between which the longitudinal sides 11, 12 of the lid D run on its first side Y1 and second side Y2, respectively.

Figure 6:
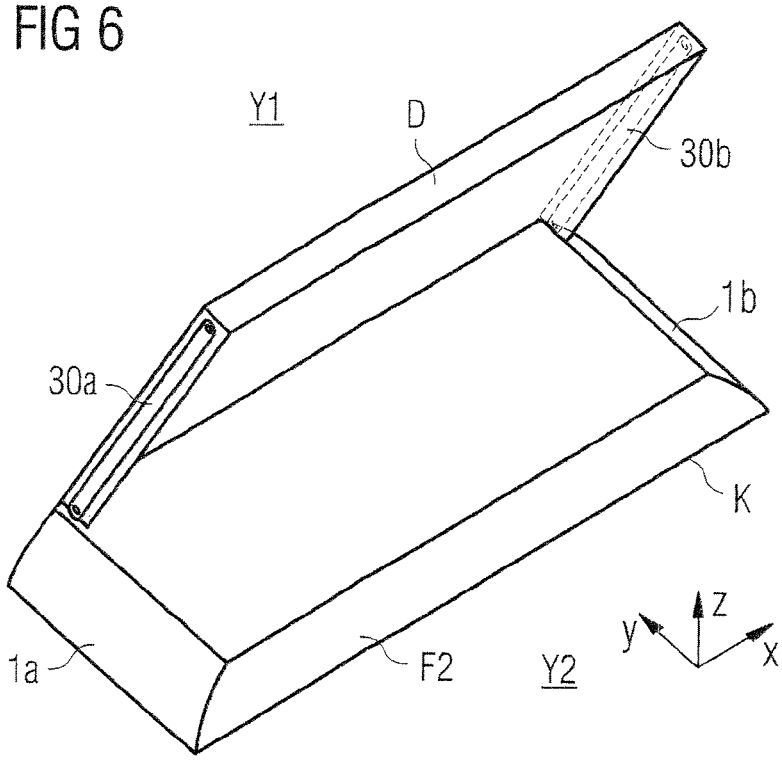
FIG. 6 shows a perspective illustration of the storage compartment with the lid element in an operating position in the viewing direction of FIG. 5, in which the lid element is opened on a first side.
Figure 7:
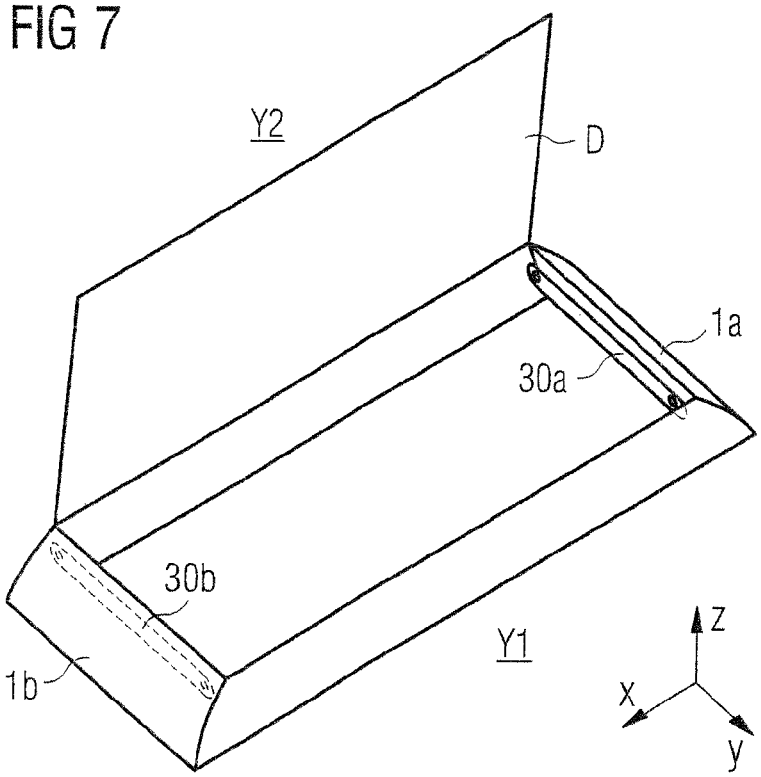
FIG. 7 shows a perspective illustration of the storage compartment with the lid element in an operating position from a viewing direction opposed to the illustration of FIG. 6, in which the lid element is open on a second side.
Figure 8:
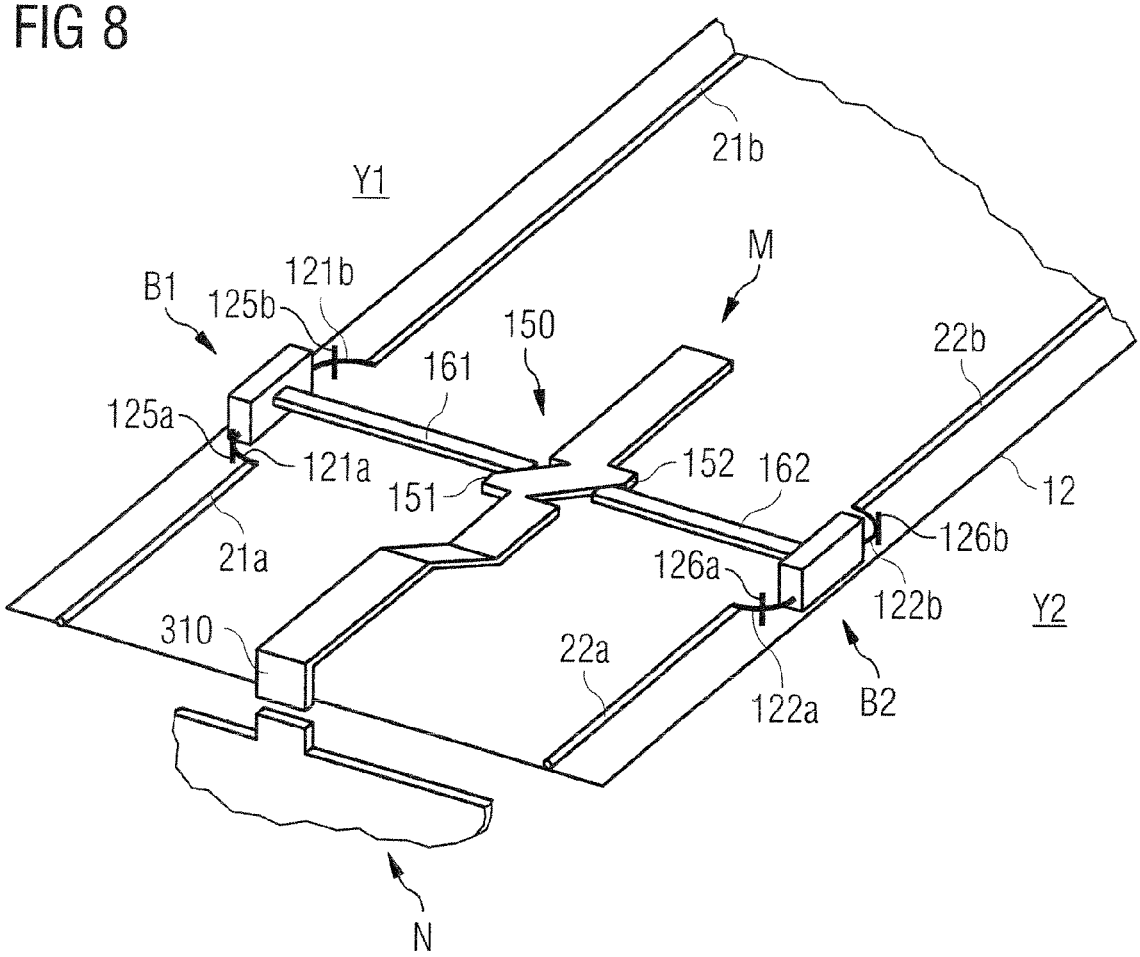
FIG. 8 shows a perspective illustration of the lid element with a pivot-spindle control device.

The opening of the lid element of or the lid D on the first side Y1 (FIGS. 1 and 7) takes place by rotation of the lid D about a first lid pivot spindle 21 positioned on a first lid longitudinal side or lid opening side 11. In an analogous manner, the opening of the lid D on the second side Y2 opposite the first side Y1 (FIGS. 2 and 6) takes place by rotation about a second lid pivot spindle 22 positioned on a second lid longitudinal side or lid opening side 12.

The first pivot spindle 21 and the second pivot spindle 22 are each formed from a front pivot-spindle element 21*a* and 22*a*, respectively, and a rear pivot-spindle element 21*b* and 22*b*, respectively, which, as seen in the longitudinal direction thereof, are preferably arranged axially one behind another and movably with respect to each other. For this purpose, the front 21*a* and rear 21*b* first pivot-spindle elements of the first pivot spindle 21 are mounted or guided by at least one guide device 23*a* and 23*b*, respectively, arranged in the lid element D. Analogously, the front 22*a* and rear 22*b* second pivot-spindle elements of the second pivot spindle 22 are mounted or guided by at least one guide device 24*a* and 24*b*, respectively, arranged in the lid element D.

The lid opening mechanism A has a lid actuating device B, having a first actuating device B1 having a first actuating element 110 and a second actuating device B2 with a second actuating element 120. The first actuating element 110 is preferably positioned on the first side Y1 of the lid D and the second actuating element 120 is preferably positioned on the second side Y2 of the lid D. The positions of the actuating elements 110, 120 can take place in particular in accordance with ergonomic aspects. For example, the actuating elements 110, 120 may also be arranged centrally on the upper side of the lid D.

The first actuating device B1 is coupled mechanically to the front pivot-spindle element 21*a* and to the rear pivot-spindle element 21*b* of the first pivot spindle 21 in such a manner that, by actuation of the first actuating device B1, the front pivot-spindle element 21*a* and the rear pivot-spindle element 21*b* are moved apart and moved into corresponding guide devices connected to the storage compartment, and therefore the first pivot spindle 21 can act as the pivot spindle for opening the lid 1 on the opposite side Y2. In an analogous manner, the second actuating device B2 is coupled mechanically to the front pivot-spindle element 22*a* and the rear pivot-spindle element 22*b* of the second pivot spindle 22 in such a manner that, by actuation of the second actuating device B2, the front pivot-spindle element 22*a* and the rear pivot-spindle element 22*b* are moved apart and are moved into corresponding guide devices connected to the storage compartment and therefore the second pivot spindle 22 can act as the pivot spindle for opening the lid 1 on the opposite side Y1.

The lid actuating device B interacts with a pivot-spindle control device M having a control element 150, which control device is provided for the purpose of, when one of the actuating elements 110 or 120 is actuated in order to activate the first or second pivot spindle 21 or 22, blocking the other actuating element 120 or 110 in each case such that the latter cannot be used to simultaneously actuate the pivot-spindle elements associated therewith. For this purpose, the actuating devices B1, B2 are functionally connected to the control element 150 which exerts the abovementioned blocking action on the respectively non-actuated actuating element.

In the case of the opening mechanism A according to the invention, the movement of the respective pair of pivot-spindle elements of the first or second pivot spindle 21 or 22 between the activated and the release positions takes place via lever devices 121 or 122 which couple the position of an actuating element 110, 120 mechanically to the position of the respectively assigned pivot-spindle elements 21*a*, 21*b* or 22*a*, 22*b*. As a result, by means of an actuation for example, of the first actuating device B1, the front pivot-spindle element 21*a* and the rear pivot-spindle element 21*b* of the first pivot spindle 21 can be pushed apart in order to move the first pivot spindle 21 into corresponding mounting devices arranged outside the lid D, and therefore the first pivot spindle 21 becomes an effective pivot spindle and the lid D can be pivoted about this first pivot spindle 21. The same applies to the second actuating device and the second pivot spindle 22.

This mechanical coupling may alternatively also be achieved in a different way. For example, the coupling between the actuating device B1, B2 and the pivot-spindle elements may also take place via a different type of mechanism or an electric drive.

The possibility of being able to open the lid D from two sides Y1 and Y2 is realized, according to the invention, by means of a front hinge strip 30*a*, which is positioned on the front region la of the console K, and a rear hinge strip 30*b* which is positioned on the rear region 1*b* of the console K. For further description, the front impact side and the rear impact side of the lid element D, which sides are arranged on the front region 1*a* and on the rear region 1*b*, are denoted by the reference numbers 6*a* and 6*b*, respectively.

The lid actuating device B with which opening and locking of the lid element 7 to two sides is possible, comprises the two lid pivot spindles 21 and 22 running along the lid opening sides 11, 12 and two front and rear hinge strips 30*a* and 30*b*, which run transversely with respect to said pivot spindles along the front and rear impact side 6*a*, 6*b* of the lid element 5 and are both mounted rotatably on the same lid opening side or lid longitudinal side, i.e. the first or second lid opening side or lid longitudinal side 11 or 12. In the embodiment shown in FIGS. 1 to 7, the first ends 31a, 31*b* of the hinge strips 30*a* and 30*b*, respectively, are positioned on the first lid opening side or longitudinal side 11 and are mounted by means of a front and a rear hinge-strip spindle 51*a* and 51*b*, respectively, called spindle elements for short below. This arrangement is taken as the starting point for the further description of the invention.

The first ends 31*a*, 31*b* of the hinge strips 30*a* and 30*b*, respectively, are each firstly mounted rotatably and preferably counter to a spring prestress on the front part 1*a* and the rear part 1*b* of the console K by means of a first mounting device 50*a* and 50*b*, respectively, and, secondly are mounted on the lid element D by means of the front pivot-spindle element 21*a* and the rear pivot-spindle element 21*b* when the front and the rear pivot-spindle elements (21*a* and 21*b*) of the first pivot spindle (21) are in the extended position. Furthermore, the second ends 32*a*, 32*b* of the hinge strips 30*a* and 30*b*, respectively, are each firstly mounted rotatably and preferably counter to a spring prestress on the lid element D by means of a second mounting device 70*a* and 70*b*, respectively, and are secondly mounted on the front part 1*a* and the rear part 1*b* of the console by means of the front pivot-spindle element 22*a* and the rear pivot-spindle element 22*b* when the front and rear pivot-spindle elements (21*a* and 21*b*) of the first pivot spindle (21) are in the extended position.

The first mounting device 50*a* and 50*b* respectively comprises the hinge-strip spindle or the spindle element 51*a* and 51*b* with which the respective hinge strip 30*a* and 30*b* is mounted rotatably and preferably counter to a spring prestress on the front part 1*a* and the rear part 1*b*, respectively, of the console 1.

Figure 1:
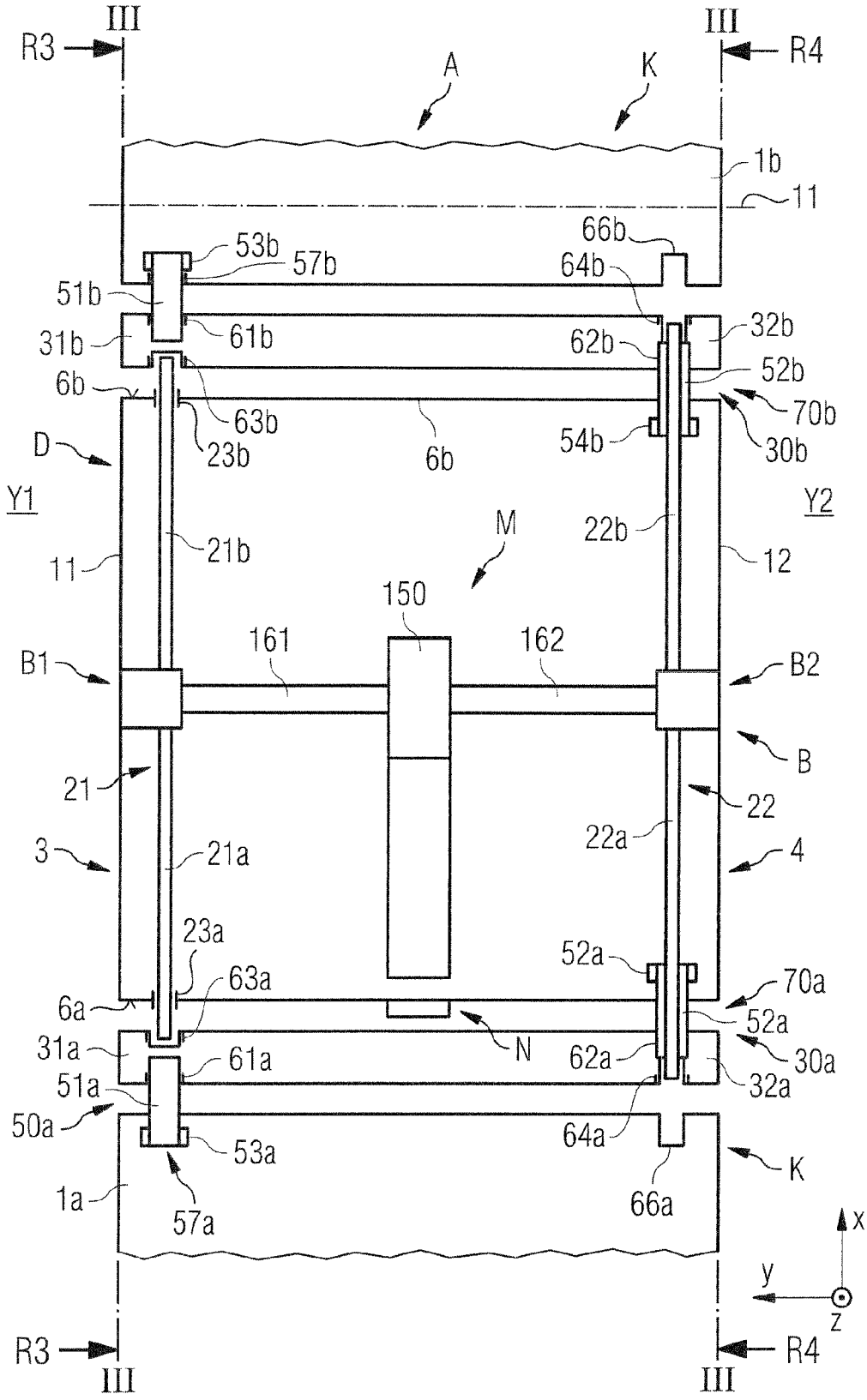
FIG. 1 shows a schematic sectional illustration of the lid opening mechanism with a coordinate system, with a setting of the lid opening mechanism being shown, in which the lid element is rotatable about the negative X axis.
Figure 2:
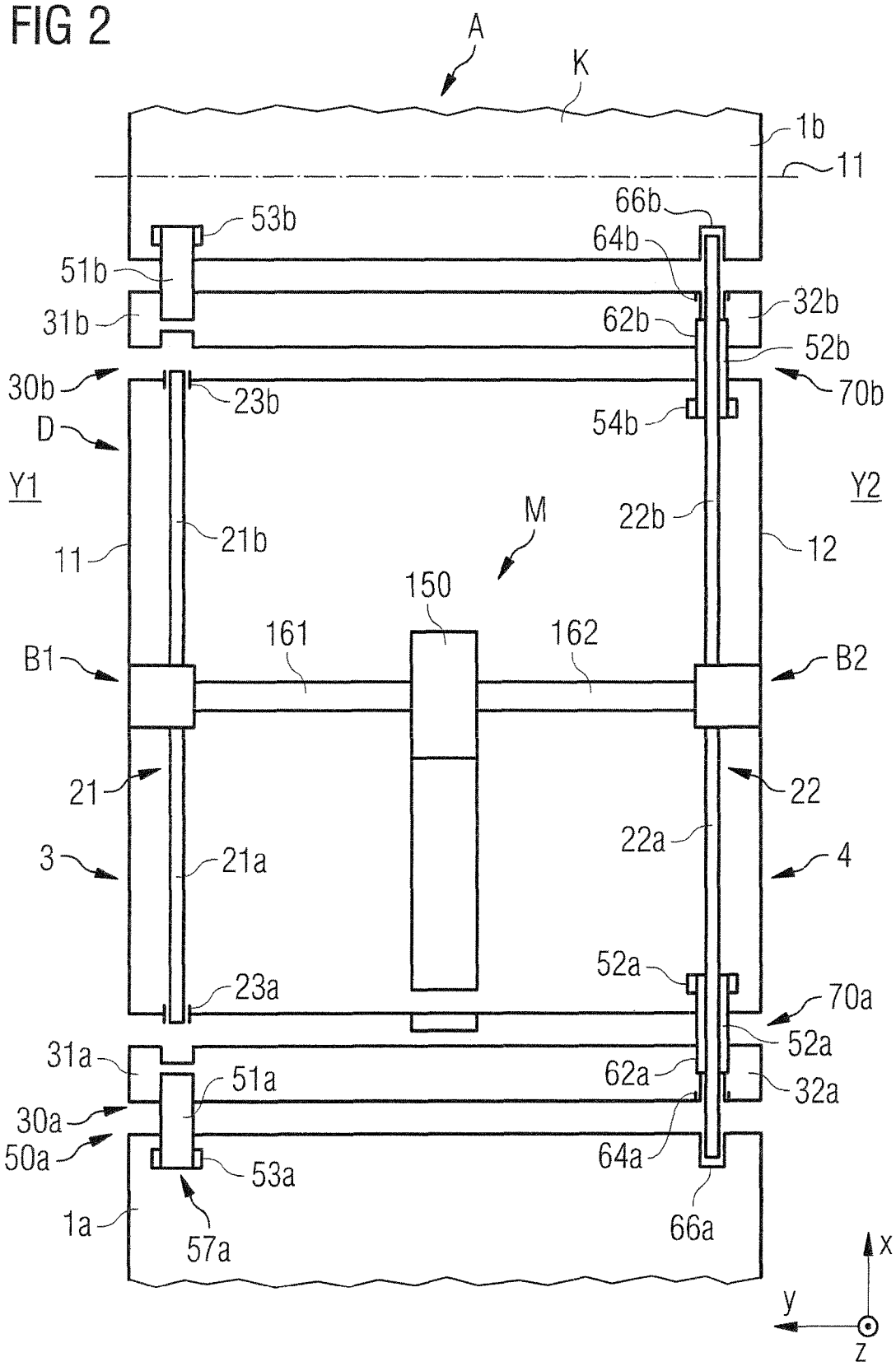
FIG. 2 shows the double-hinge device in the illustration according to FIG. 1, with a setting of the double-hinge device being shown, in which the lid element is rotatable about the positive X axis.
Figure 3:
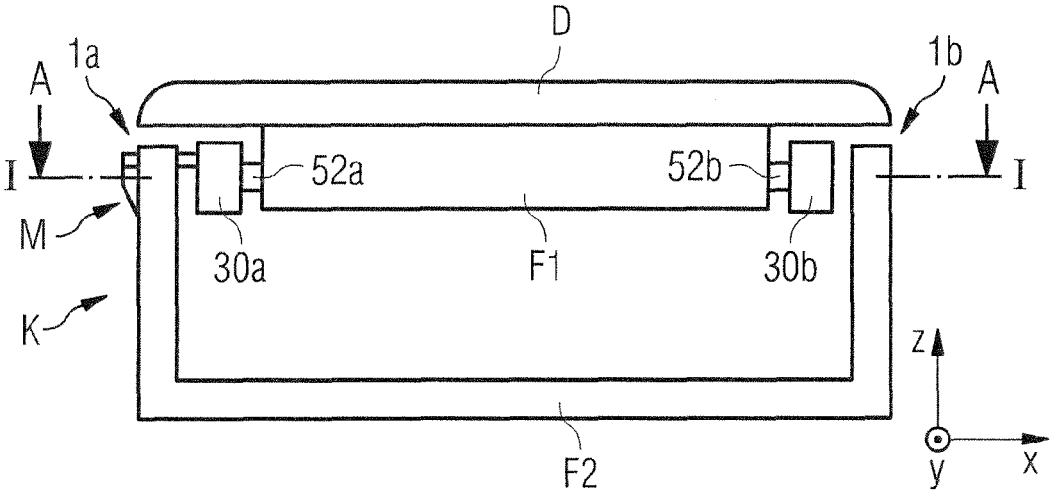
FIG. 3 shows a schematic longitudinal section of the double-hinge device through the plane III of FIG. 1, as seen in the viewing direction R3.
Figure 4:
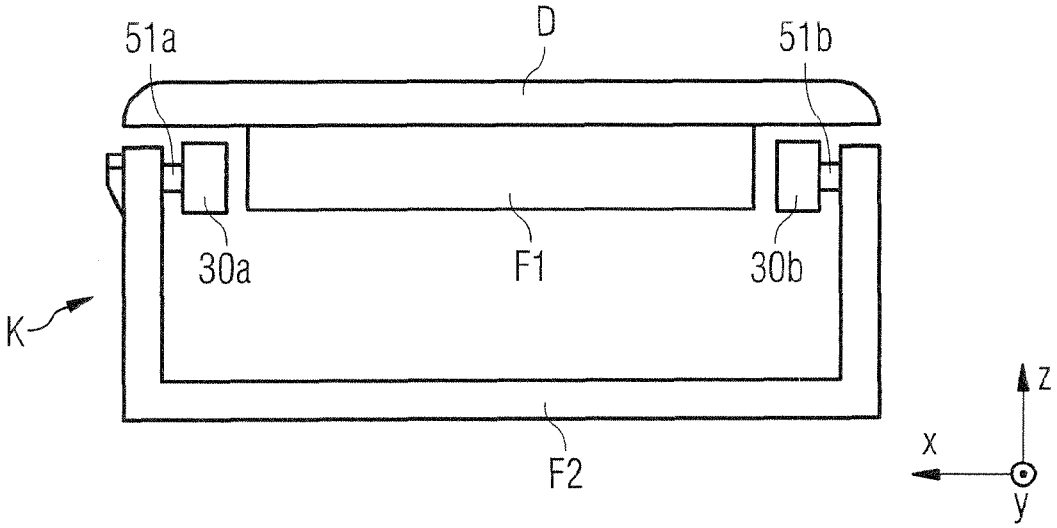
FIG. 4 shows a schematic longitudinal section of the double-hinge device through the plane IV of FIG. 1, as seen in the viewing direction R4.

In the embodiment according to FIGS. 1 and 2, the spring prestress preferably provided is realized by means of a respective front spring element 53*a* and a rear spring element 53*b* or by one of these spring elements which is firstly fastened to a fastening device (not shown) on the front part 1*a* or rear part 1*b* and is secondly fastened to the hinge-strip spindle 51*a* or 51*b* when the transmission element is mounted in a form-fitting manner in the hinge strip 30*a*, 30*b*. Alternatively, the transmission element can be mounted in a form-fitting manner in the front or rear part and rotatably in the hinge strips, with the spring element then being fastened, on the one hand to the transmission element and, on the other hand, to the hinge strip. An essential feature for the various designs is that the at least one spring element 53*a*, 53*b* acts between the hinge strips 30*a*, 30*b* and the respective part 1*a* or 1*b* of the upper compartment 5. The force of the spring stress preferably acts in the opening movement of the lid element D about the first pivot spindle 21, i.e. the rotational force of the spring is directed in the positive X direction. As a result, an equilibrium of forces can be achieved for the weight of the lid element 7, between frictional forces of the pivot bearings and between the spring force in a partially or completely opened position, and the lid element 7 can be held stably in such a position.

In a preferred embodiment, the hinge-strip spindle 51*a* is mounted rotatably in a mounting device 61*a* in the front part 1*a* and in a rotationally fixed manner in a mounting device 59*a* in the front hinge strip 30*a*. Analogously to this, the hinge-strip spindle 51*b* is mounted rotatably in a mounting device 57*b* in the rear part 1*b* and in a rotationally fixed manner in a mounting device 61*b* in the rear hinge strip 30*b*. The mounting devices 61*a*, 61*b* are arranged on that side of the hinge strip 30*a* and 30*b* which faces the front part la and rear part 1*b*, respectively, in order to receive the hinge-strip spindles 51*a* and 51*b*, respectively. The rotational strength of these mounting devices 61*a*, 61*b* is preferably achieved by the bearing contour of the mounting devices 61*a*, 61*b* interacting in a form-fitting manner with the corresponding cross sections of the hinge-strip spindles 51*a* and 51*b*. As an alternative to this embodiment, the hinge-strip spindle can be mounted rotatably on the front part 1*a* or rear part 1*b* by means of the mounting device 57*a* or 57*b* and can be mounted rotatably on the hinge strip 30*a* or 30*b* by means of the mounting device 61*a* or 61*b*, with the spring element 53*a* or 53*b* then being fastened, firstly, to the hinge-strip spindle 51*a* or 51*b* and, secondly, to a fastening device (not shown) on the hinge strip 30*a* or 30*b*. In a further alternative, the rotatable mounting of the hinge strip 30*a* or 30*b*, which mounting is provided with a spring prestress, may also be realized in a different manner.

A mounting device 63*a* and 63*b* for the mounting of the longitudinally displaceable pivot-spindle elements 21*a* and 21*b* is arranged on those sides of the first ends 31*a*, 32*a* of the hinge strips 30*a* and 30*b* which face the lid element D. The mounting of the longitudinally displaceable pivot-spindle elements 21*a* and 21*b* in the corresponding mounting device 63*a* and 63*b*, respectively, then takes place when the pivot-spindle elements 21*a* and 21*b* have been brought by means of the actuating device B1 into an extended position with respect to each other.

The front and rear pivot-spindle elements 21*a*, 21*b* can be extended out of the respective mounting device 63*a* and 63*b* or can be retracted therein by means of the first actuating device B1. In the extended state, in which the pivot-spindle elements are retracted into the respective mounting devices 63*a* and 63*b*, the lid element D is fixed on the first lid longitudinal side 11 transversely with respect to the axial direction of the first pivot spindle 21 and is mounted rotatably.

The second mounting device 70*a* and 70*b* optionally comprises in each case a front and rear guide element 52*a* and 52*b*, with which the respective hinge strip 30*a* and 30*b* is mounted rotatably and preferably counter to a spring prestress on that side of the lid element D which faces the particular hinge strip 30*a* and 30*b*. The guide element may also be omitted, since, even in their brought-together position, the pivot-spindle elements 22*a*, 22*b* of the second pivot spindle 22 can still partially reach into the mounting device 64*a*, 64*b* or a corresponding hole in the hinge strips and, as a result, can form a corresponding spindle.

In the embodiment according to FIGS. 5*a* and 5*b*, the spring prestress which is preferably provided is realized by a front spring element 54*a* or a rear spring element 54*b* which is firstly fastened to a fastening device (not shown) on the lid element D and secondly to the guide element 52*a* or 52*b*. It is essential that the at least one spring element 54*a*, 54*b* acts between the hinge strips 30*a*, 30*b* and the particular side of the lid element D. The force of the spring stress preferably acts in the opening movement of the lid element D about the second pivot spindle 22, i.e. the rotational force of the spring is directed in the negative X direction in order, during opening of the lid element D on the second longitudinal side 11, to achieve an equilibrium of forces for the weight of the lid element D, between frictional forces of the pivot bearings and between the spring force in a partially or completely opened position, and in order to be able to stably hold the lid element D in such a position. In this case, the front guide element 52*a* can be mounted rotatably in a mounting device 58*a* in the lid element D and in a rotationally fixed manner in a mounting device 62*a* in the front hinge strip 30*a*, or vice versa. Analogously thereto, the guide element 52*b* can be mounted rotatably in a mounting device 58*b* in the lid element D and in a rotationally fixed manner in a mounting device 62*b* in the rear hinge strip 30*b*. The mounting devices 62*a*, 62*b* are arranged for receiving the guide elements 52*a* and 52 on that side of the hinge strips 30*a* and 30*b* which faces the lid element D. The rotational strength of these mounting devices 62*a*, 62*b* is preferably achieved by the outer contour of the transmission elements 52*a* and 52*b* interacting in a form-fitting manner with the corresponding cross sections of the mounting elements 62*a*, 62*b* of the hinge strips. As an alternative to this embodiment, the guide elements 52*a*, 52*b* can be mounted in a rotationally fixed manner on the corresponding side of the lid element D by means of the mounting device 58*a* and 58*b* and can be mounted rotatably on the hinge strip 30*a* and 30*b* by means of the mounting device 62*a* and 62*b*, with the spring elements 54*a* and 54*b* then firstly being fastened to the guide elements 52*a* and 52*b* and secondly to a fastening device (not shown) on the hinge strip 30*a* and 30*b*. In a further alternative, the rotatable mounting of the hinge strip 30*a* and 30*b*, which mounting is provided with a spring prestress, may also be realized in a different manner. In particular, the rotatable and sprung mountings of the front and rear hinge strips may also be realized differently.

A respective mounting device 64*a* and 64*b*, preferably in the form of continuous holes for the mounting of the longitudinally displaceable pivot-spindle elements 21*a* and 21*b* is arranged at the second ends 32*a*, 32*b* of the hinge strips 30*a* and 30*b*. Furthermore, mounting devices 66*a*, 66*b* are arranged on that side of the front part 1*a* and rear part 1*b* which faces away from the respective hinge strips 30*a* and 30*b*. The mounting devices 66*a*, 66*b* are positioned opposite the mounting devices 64*a* and 64*b* when the lid element is in the closed position. If, on account of a corresponding actuation of the second actuating device B2, the pivot-spindle elements 22*a*, 22*b* have been moved into their extended position relative to each other, they protrude through the mounting devices 64*a* and 64*b*, respectively, and the respective ends of the pivot-spindle elements 22*a*, 22*b* are received or supported by the corresponding mounting devices 66*a*, 66*b*. In this extended state of the pivot-spindle elements 22*a*, 22*b*, the lid element D is fixed on the second lid longitudinal side 12 transversely with respect to the axial direction of the second pivot spindle 22 and is mounted rotatably on the hinge strips and therefore also in relation to the front part and rear part 1*a* and 1*b* (FIG. 2). The front and rear pivot-spindle elements 22*a*, 22*b* can be extended out of the respective bearing device 66*a* and 66*b* or can be retracted into the latter by means of the second actuating device B2. If, on account of a corresponding actuation of the actuating device B2, the pivot-spindle elements 22*a*, 22*b* have been moved into their position in which they are brought together relative to each other, they partially protrude through the mounting devices 64*a* and 64*b*, and the respective ends of the pivot-spindle elements 22*a*, 22*b* are not received by the corresponding mounting devices 66*a*, 66*b* (FIG. 1). In this state, the second ends 32*a*, 32*b* of the hinge strips 30*a* and 30*b* are therefore fixed on the second longitudinal side 11 of the lid element D transversely with respect to the axial direction of the second pivot spindle 22 via the pivot-spindle elements 22*a*, 22*b* but the second ends 32*a*, 32*b* of the hinge strips 30*a* and 30*b* are released transversely with respect to the axial direction of the second pivot spindle 22 in relation to the front part 1*a* and rear part 1*b* of the console K via the pivot-spindle elements 22*a*, 22*b*.

The mounting of the lid element D with a first lid longitudinal side 11 and a second lid longitudinal side 12, which run on the opening sides of said lid element, on a console or receptacle B with a first console longitudinal side 1 and second console longitudinal side 2 respectively assigned to the first lid longitudinal side 11 and second lid longitudinal side 12 therefore takes place by means of first pivot-spindle elements 21*a*, 21*b* and second pivot-spindle elements 22*a*, 22*b*, which are arranged on the lid element D and can each be extended and brought together in their longitudinal direction and run along the first lid longitudinal side 11 and the second lid longitudinal side 12, respectively, by means of hinge strips 30*a*, 30*b*, which are arranged rotatably in the region of a first lid opening side 11 on corresponding regions 1*a*, 1*b* of the console K and have the mounting devices 63*a*, 63*b* and 62*a*, 62*b* for receiving the pivot-spindle elements 21*a*, 21*b* and 22*a*, 22*b*, respectively, by means of hinge-strip spindles 51*a*, 51*b* for the rotatable mounting of those ends 31*a*, 31*b* of the hinge strips which are positioned in the region of the first longitudinal side 11 on the front and rear regions 1*a*, 1*b* of the console K in order to be able to pivot up the lid element D on the second longitudinal side 12 when the first pivot-spindle elements 21*a*, 21*b* are retracted into the mounting devices 63*a*, 63*b* of the hinge strips and the second pivot-spindle elements are moved back out of the mounting devices 66*a*, 66*b*, wherein, in a retracted position, the pivot-spindle elements 22*a*, 22*b* on the second longitudinal side 12 partially reach into mounting devices 62*a*, 62*b* of the hinge strips in order to form a swivel joint between the lid element D and the hinge strips in the region of the second longitudinal side 12 if the pivot-spindle elements 21*a*, 21*b* of the first pivot spindle 21 are at the same time moved out of the mounting devices 63*a*, 63*b* of the hinge strips 30*a*, 30*b*, and therefore the lid element D can be pivoted up on the first longitudinal side 11.

Figure 5:
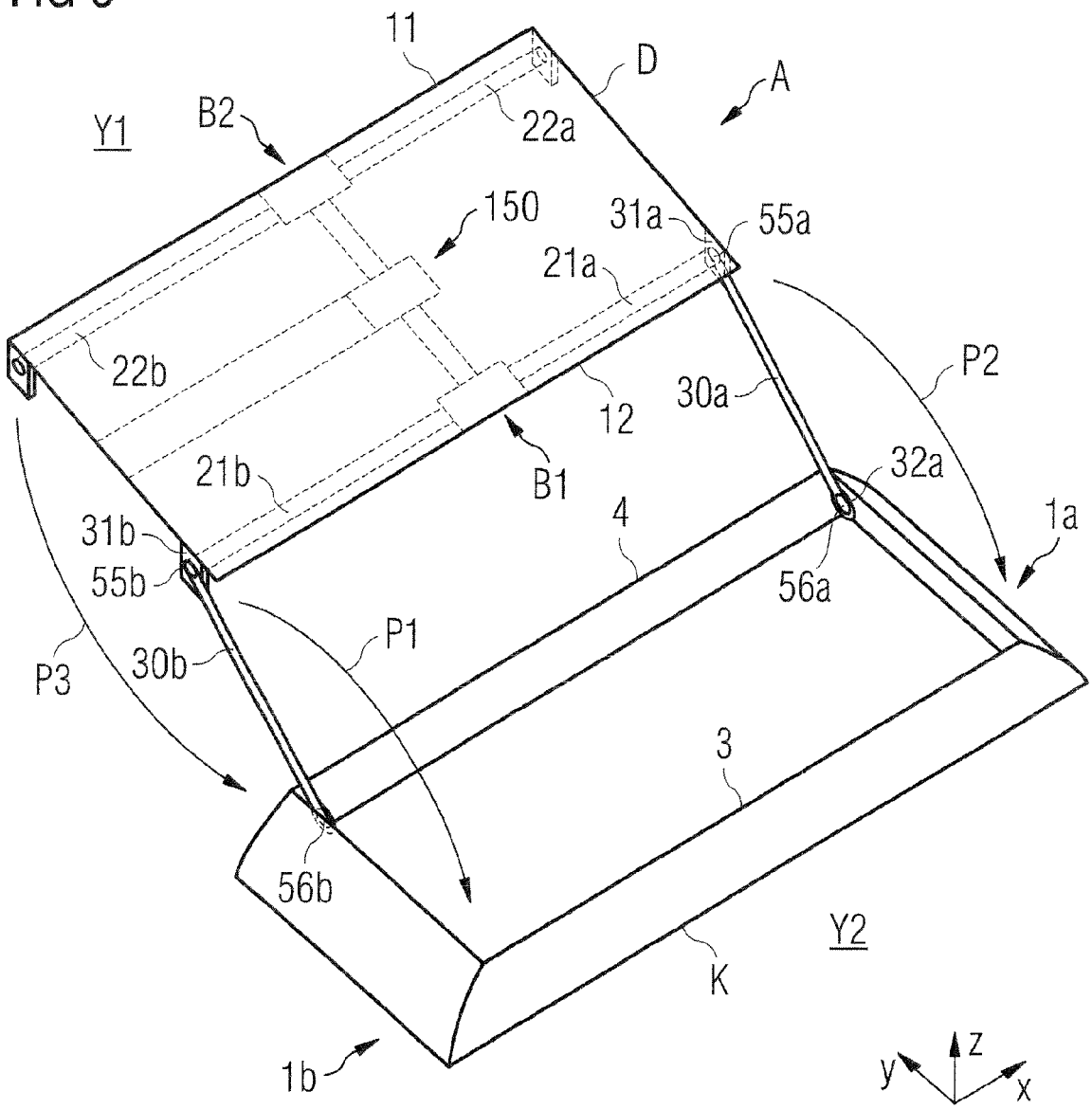
FIG. 5 shows a perspective illustration of the additional compartment with the lid element in an installation position, in which the lid element, connected to the storage compartment via hinge strips, is shown raised from said storage compartment.

In order to clarify the manner of operation of the lid opening mechanism A, FIG. 5 shows in general, in a perspective illustration, a console K in the form of a storage compartment F1 with the lid element D and the hinge strips 30*a*, 30*b* in a disassembled state in which the lid element D is connected via the hinge strips to the console K or to the compartment and is shown raised from said console or said compartment and in which, however, the first supporting or longitudinal side 3 and second supporting or longitudinal side 4 of the compartment F1 are not—as provided in the operating position—brought to bear against the longitudinal sides 11, 12 of the lid element. During the transition from this installation position into the operating position, the first supporting or longitudinal side 3 and the second supporting or longitudinal side 4 of the console or receptacle K are therefore brought to bear against the longitudinal sides 11 and 12, respectively, of the lid element by the hinge strips being pivoted according to the arrows P1, P2 and the lid element D being pivoted according to the arrow PS.

In a special development of the invention, the pivot-spindle control device M provided according to the invention comprises two actuating rods 161, 162 which are respectively functionally connected to the pivot spindles 21, 22 via a respective actuating device B1 and B2, via which the respective pivot-spindle elements are pushed together or moved apart on the basis of a corresponding choice made by a user. The pivot-spindle control device M can be positioned between the first and the second pivot spindle 21, 22 and between the first and the second actuating device B1 and B2 and has a control element 150. The control element 150 can be designed by means of its shaping in such a manner that it can be moved in a defined manner only by means of that actuating rod 161, 162 which is activated or moved by means of a corresponding actuating device B1 or B2 assigned to it. The effect achieved by the shaping of the control element 150 is that, during a movement by means of an actuating rod 161 or 162 relative to the other actuating rod 162 or 161, the control element 150 is pushed into a position in which said other actuating rod 162 or 161 cannot move the control element 150.

One of the transmission rods 161, 162 in each case can be blocked via a control element 150 as soon as the respectively other transmission rod 161, 162 has been brought by means of the actuating device B1 or B2 correspondingly assigned thereto into the activated or released position. The effect achieved by this manner of operation of the pivot-spindle locking device M is that the lid element 7 can optionally be opened exclusively only on one longitudinal side 11, 12.

FIGS. 1 and 2 show the two settings with which the lid element D can be rotated, firstly, about the positive X axis and, secondly, about the negative X axis. The rotation about the negative X axis takes place about the first lid pivot spindle 21 (FIG. 1), the rotation about the positive X axis takes place about the second lid pivot spindle 22 (FIG. 2). When the rotatability about the positive X axis is enabled (FIG. 2), the rotation about the negative X axis is blocked by means of the control device M. Conversely, when the rotatability about the negative X axis is enabled (FIG. 2), the rotation about the positive X axis is blocked by means of the control device M.

The actuating device B1, B2 has the effect that, by means of the actuation of the first actuating element B1, the first front pivot-spindle element 21*a* and the first rear pivot-spindle element 21*b* are moved apart and, by the actuation of the second actuating element B2, the second front pivot-spindle element 22*a* and the second rear pivot-spindle element 22*b* are moved apart. In the case of this embodiment, the effect achieved by the control device M is that, in a first operation, when, for example, the first pivot-spindle elements 21*a*, 21*b* are moved together on the basis of the actuation of the first actuating element B1 in the actuating direction, the second actuating rod 162 is pressed in the actuating direction by means of the control element 150 in order to lock the second actuating element in its initial position. As a result, it is not possible to open the lid D at the same time on the second longitudinal side 12.

The actuating elements B1, B2 and the pivot-spindle control device M which is in an operational interrelationship therewith, can be designed differently if they carry out the manner of operation described. The actuating elements B1, B2 and the pivot-spindle control device M are described below in the embodiment according to FIGS. 9 to 12.

The actuating elements 110, 120 of the actuating devices B1 and B2 respectively, are movable between two switching positions and, for this purpose, are guided in a guide or guide device 111, 112. There is firstly linked to each switch element 110, 120 a lever 121*a*, 122*a* which acts on the front pivot-spindle elements 21*a* and 22*a*, respectively via a bearing element 123*a*, 124*a*. There is secondly linked to each switch element 110, 120 a lever 121*b*, 122*b* which acts on the rear pivot-spindle element 21*b*, 22*b* via another bearing element 123*b*, 124*b*. The guide 111 may also alternatively be entirely omitted or replaced by a functionally identical element, such as, for example, by a lever. It is essential that the switching travel predetermined between the switching positions is transmitted, for example via the levers 121*a*, 121*b* and 122*a*, 122*b* to the pivot-spindle elements 21*a*, 21*b* and 22*a*, 22*b*, respectively, in such a manner that the pivot-spindle elements 21*a*, 21*b* and 22*a*, 22*b* are brought from a first position or initial position of the switch element 110, in a position in which they are close to each other or brought together, into a second position or opening position, in which the pivot-spindle elements 21*a*, 21*b* and 22*a*, 22*b* are placed in a position in which they are moved apart. In the embodiment of the actuating devices B1, B2 according to FIG. 12, the levers 121*a*, 121*b* and 122*a*, 122*b* are mounted in a joint 125*a*, 125*b* and 126*a*, 126*b*, respectively, and, in addition, are connected at one end in an articulated manner to the guide device 111, 112, via a driver or via a joint 127*a*, 127*b* and 128*a*, 128*b*, or to the switch element 110 directly.

The switch element 110 or 120 acts via actuating rods 161 or 162 on a control slide 150 with a first control surface 151 for controlling the first actuating rod 161 and a second control surface 152 for controlling the second actuating rod 162. The control surfaces 151, 152 are designed in such a manner that, upon a movement of the first switch element 110 into its second or pressed-in position, the movement of the second switch element 112 is blocked and, as a result, it is held in its initial position and, conversely, that, upon a movement of the second switch element 120 into its second or pressed-in position, the movement of the first switch element 110 is blocked and, as a result it is held in its initial position. Furthermore, the control surfaces are designed in such a manner that upon the movement of the first switch element 110 into its second position, the control slide 150 is pushed into a first position (FIG. 10) and, upon the movement of the second switch element 120 into its second position, said control slide 150 is pushed into a second position (FIG. 11), i.e. into end positions in each case.

Latching elements 165 and 166 are arranged on the actuating rods 161, 162 or on the control slide 150 and latch into corresponding latching devices arranged on the lid element D when the actuating rods 161, 162 have been moved into positions corresponding to the second positions of the actuating elements 110, 120 or the control slide 150 has been moved into its end positions.

By means of a resetting mechanism N, the actuating rods and the actuating elements are brought into their initial position.

In a preferred embodiment, the control slide 150*a* or the control surfaces 151, 152 thereof in the bearing surfaces 155, 156, which interact therewith, of the actuating rods 161, 162 are formed according to FIGS. 9 to 11. The control surface facing the first or second actuating rod 161 or 162 has a surface 171 or 172 running obliquely with respect to the longitudinal direction of the actuating rod 161 or 162 and a surface 173 or 174 which runs transversely with respect to this longitudinal direction and in which a movement of the control slide 150*a* relative to the actuating rod 161 or 162 is prevented. The bearing surface 155, 156 of the first and second actuating rod 161 and 162 also preferably has a surface 175 and 176 running obliquely with respect to the longitudinal direction of said actuating rod and a surface 177 and 178 running transversely with respect thereto, with the surface 175 and 176 mentioned first running parallel to the obliquely running control-slide surface 171 and 172 and the surface 177 and 178 mentioned last running parallel to the transversely running control-slide surface 173, 174.

A transversely running surface 173 and 174 and an obliquely running surface 171 and 172 respectively face an actuating rod 161, 162. The obliquely running surfaces 171 and 172 are arranged, in the longitudinal direction of the slide 150*a*, in some regions on opposite sides of the control slide. The transversely running surfaces 173 and 174 of different sides of the control slide 150*a* are offset with respect to each other in that, when an actuating rod 161, 162 bears against a transversely running surface 173 and 174, and the other actuating rod 162 and 161 bears against an obliquely running surface 172 and 171, and vice versa.

In the initial position, the oblique surface 171 of the control surface 151 and the oblique surface 175 of the actuating rod bear against each other (FIG. 9). That surface 177 of the actuating rod which runs transversely with respect to the longitudinal direction of the actuating rod and that surface 173 of the control surface 151 which runs transversely with respect thereto are arranged opposite each other with respect to the region, which arises in this position, of oblique surfaces bearing against each other.

The orientation of the obliquely running surfaces and the manner of operation of the control slide 150 with the actuating rods 161, 162 are as follows: when an actuating rod 161 or 162 is actuated into a second position, the respective, obliquely running surfaces 171, 175 and 172, 176 slide on each other, as a result of which the control slide 150 is moved transversely with respect to the longitudinal direction of the actuating rods 161, 162.

On the side opposite the actuating side, the respective, transversely running surface 178 or 177 of the respectively non-actuated actuating rod 162 or 161 is moved onto the vertically running surface 174 or 173 of the control surface 152, 151 until, finally, the vertically running surface 178 or 177 of the actuated actuating rod 162 or 161 is brought to bear against the vertically running surface 174 or 173 of the control surface 152, 151 (FIGS. 10, 11). In this state, the transversely running surfaces block a movement of the actuating rod on the side which lies opposite the actuating side. Thus, in the situation in which the lid element D is opened on one side, the actuating element of the respectively other side can be blocked and cannot be actuated.

If one of the pivot spindles 21, 22 is in its locked position and the respectively opposite pivot spindle is in its release position such that the lid element D can be opened on the longitudinal side positioned there, the pivot-spindle elements are set back into their initial position by means of a resetting mechanism N. The resetting mechanism N can be designed in different ways according to the prior art.

The resetting mechanism N can be realized by one or more spring devices. In a preferred embodiment, the control slide 150 is prestressed on both sides into an intermediate position, positioned between the end positions by means of a spring device in a manner in which the control slide 150 is moved automatically from an end position into its central position by means of the spring device, as soon as latching elements (not shown) have been brought out of their latching devices by means of corresponding bearing surfaces during closure of the lid D. This takes place via an unlocking device which acts on the control slide 150 in a corresponding manner when the lid, which is open on one lid longitudinal side 11, 12, is closed and the corresponding lid longitudinal side 11, 12 comes to bear against the respective console longitudinal side 1, 2.

FIGS. 12 and 13 schematically illustrate a further possible embodiment of a resetting mechanism N. This embodiment has a cam connected to the console K and a cam guide connected to the control element 150. The cam guide limits the position of the cam N1 relative to the control element 150, which is longitudinally displaceable relative to the cam. In this case, the shape of the cam guide is designed, for example, by means of correspondingly running ramps, in such a manner that the control element is pushed into a central position when the lid D is pivoted from an open position into the closed position. The manner of operation of the closing of the lid element D on its first lid longitudinal side 11 and on its second lid longitudinal side 12 and the moving back of the pivot-spindle elements into their initial position by means of the resetting mechanism N are as follows: compartment F2 but rather is in an open position. For this purpose, a control lug 310 can be arranged on the console K. Said control lug has two bearing elements 311, 312 which in turn interact with a respective bearing element 321, 322 of a blocking lever device 320 when the lid element D is closed. The blocking lever device 320 comprises two levers 321, 322 which are connected to each other in an articulated manner and provide the actuating switch 110 and 120 at their respective ends or are connected thereto. By interaction of the bearing elements, the mobility of the levers 331, 332 is blocked and therefore so too is the actuation of the actuating switches or of the switch elements 110, 120, and therefore opening of the lid element D is not possible.

In order to open the lid element D on its second lid longitudinal side 12, by actuation of the second actuating element B2, the second pivot-spindle elements 22*a*, 22*b* are moved out of the mounting devices 66*a*, 66*b* into parts 1*a* and 1*b* of the console K, which parts bear against the lid element D, so as to release the second lid longitudinal side 12 in relation to the adjacent console longitudinal side. As a result, the first hinge-strip spindles 51*a*, 51*b* become pivot spindles for opening the lid element D together with the hinge strips 30*a*, 30*b* on the first longitudinal side 11, with the ends of the first pivot-spindle elements 21*a*, 21*b* fixing the mobility between the lid element D on its first longitudinal side 11 and the ends 31*a*, 32*a* which are situated in the vicinity thereof, of the hinge elements 30*a*, 30*b* the lid element D transversely with respect to the first pivot spindle 21 (FIG. 1). Since the lid D can be opened beforehand and the pivot-spindle elements can be in a position in which they are brought together, the resetting mechanism N is provided and is used to retract the first pivot-spindle elements 21*a*, 21*b* into corresponding mounting devices 63*a*, 63*b* in the ends 31*a*, 31*b* of the hinge elements 30*a*, 30*b* (which ends are positioned on the first pivot-spindle elements 21*a*, 21*b* in the closed state of the lid element D). The same applies to the second first pivot-spindle elements 22*a*, 22*b*.

In the situation in which the double compartment installation has a lower container F2 on which an upper container F1, which can be pivoted via the pivoting mechanism 10, is arranged, a lid locking and release device or lid misoperation lock 300 is provided, with which the opening mechanism A of the lid is blocked if the pivoting mechanism is released, and vice versa. This is used to block an opening of the lid element D as soon as or as long as the upper compartment F1 is not resting in its initial position on the lower.

The invention claimed is:

1. A lid opening mechanism comprising:

a lid;

a console, wherein the lid and the console each have first and second longitudinal sides and front and rear sides, respectively, the front and rear sides running transverse relative to the first and second longitudinal sides;

a first lid pivot spindle provided on the lid having a first front pivot-spindle element and a first rear pivot-spindle element, the first front and rear pivot-spindle elements each being movable between a retracted position and an extended position;

a second lid pivot spindle provided on the lid having a second front pivot-spindle element and a second rear pivot-spindle element, the second front and rear pivot-spindle elements each being movable between a retracted position and an extended position;

a first actuating element mechanically coupled to the first front and rear pivot-spindle elements;

a second actuating element mechanically coupled to the second front and rear pivot-spindle elements;

a front hinge strip and a rear hinge strip, each hinge strip having a first end and a second end, wherein the first end of each of the front and rear hinge strips is rotatably mounted to the front and rear sides of the console, respectively, in a region of one of the first longitudinal side and the second longitudinal side by front and rear first mounting devices, and the second end of each of the front and rear hinge strips is rotatably mounted to the front and rear sides of the lid, respectively, in a region of the other one of the first longitudinal side and the second longitudinal side by front and rear second mounting devices;

wherein actuation of the first actuating element extends the first front and rear pivot-spindle elements into corresponding first end front and rear hinge mounting devices provided at the first end of each of the front and rear hinge strips for pivoting the lid about the first pivot spindle along the first longitudinal side, the second front and rear pivot-spindle elements being simultaneously retracted, wherein actuation of the second actuating element extends the second front pivot-spindle element and the second rear pivot-spindle element through corresponding second end front and rear hinge mounting devices, respectively, provided at the second end of each of the front and rear hinge strips, and into corresponding front and rear console mounting devices, respectively, for pivoting the lid about the second pivot spindle on the second longitudinal side, the first front and rear pivot-spindle elements being simultaneously retracted, and wherein when the second front and rear pivot-spindle elements are retracted from the corresponding front and rear console mounting devices, the second front and rear pivot-spindle elements remain partially inserted in the second end front and rear hinge mounting devices.

2. The lid opening mechanism according to claim 1, the front and rear hinge strips are respectively mounted on the front and rear sides of the console counter to a spring prestress.

3. The lid opening mechanism according to claim 1, further comprising a control element, wherein the first and second actuating elements are each coupled to the control element by a first and a second actuating rod, respectively, the control element being arranged between the first and second actuating rods, and wherein upon a movement of one of the first and second actuating rods, the control element is pushed relative to the other of the first and second actuating rods into a position in which the other of the first and second actuating rods cannot move the control element.

* * * * *